US010470541B2

(12) United States Patent
Moon

(10) Patent No.: US 10,470,541 B2
(45) **Date of Patent: *Nov. 12, 2019**

(54) CARD WALLET

(71) Applicant: Decadent Minimalist Inc., Algona, WA (US)

(72) Inventor: Erik P. Moon, Algona, WA (US)

(73) Assignee: Decadent Minimalist Inc., Algona, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/627,326

(22) Filed: Jun. 19, 2017

(65) Prior Publication Data

US 2017/0280846 A1 Oct. 5, 2017

Related U.S. Application Data

(63) Continuation of application No. 14/457,403, filed on Aug. 12, 2014, now Pat. No. 9,681,721.

(51) Int. Cl.
*A45C 11/18* (2006.01)

(52) U.S. Cl.
CPC ..... *A45C 11/182* (2013.01)

(58) Field of Classification Search
CPC ..... A45C 11/182
See application file for complete search history.

(56) References Cited

U.S. PATENT DOCUMENTS 438,280 A * 10/1890 Wright ..... A47B 96/061 108/152
985,525 A 2/1911 Hamill
1,097,851 A 5/1914 Dieges
(Continued)

FOREIGN PATENT DOCUMENTS

CN 2012243708 Y 5/2009
CN 201822139 U 5/2011
(Continued)

OTHER PUBLICATIONS

Gregory Venters, "Omega-Compact Solid Titanium Wallet", Jan. 24, 2013, pp. 1-8, https://www.kickstarter.com/projects/331414694/omega-compact-solid-titanium-wallet.
(Continued)

*Primary Examiner* — Tri M Mai
(74) *Attorney, Agent, or Firm* — Intellectual Property Law Group LLP

(57) ABSTRACT

Disclosed is a card wallet for use with cards such as identification cards, credit cards, RFID cards. The card wallet comprises a base and lower and upper arms extending from the base. The lower arm and upper arms each comprise a channel portion and a protrusion disposed at an outer end portion. The base and channel portions of the lower and upper arms form a retention area. The protrusions moveable between a non-biased position where the retention area is closed and a biased position where the retention area is open. In operation, the protrusions of the lower and upper arms are moved to the biased position upon insertion of the cards at the protrusions allowing complete insertion of the cards and then return of the protrusions of the lower and upper arms to the non-biased position where the cards are retained within the retention area.

16 Claims, 5 Drawing Sheets

(56) References Cited

U.S. PATENT DOCUMENTS

| | | | | |
|---|---|---|---|---|
| 1,151,248 | A | 8/1915 | Dieges | |
| 1,503,144 | A | 7/1924 | Warwick | |
| 1,710,828 | A | 4/1929 | Keen | |
| 2,084,085 | A | 6/1937 | Hartzell | |
| 2,185,359 | A | 1/1940 | Swanson | |
| 2,569,629 | A | 10/1951 | Everitt | |
| 3,062,364 | A | 11/1962 | Ziemski | |
| 3,648,832 | A | 3/1972 | Kirshenbaun et al. | |
| 3,659,640 | A | 5/1972 | Fenster et al. | |
| D256,852 | S | 9/1980 | McGahee | |
| 4,316,539 | A | 2/1982 | Torrington | |
| 4,753,405 | A * | 6/1988 | Camilleri | A47B 96/061 108/134 |
| 4,817,253 | A | 4/1989 | Harmatuik | |
| 5,161,682 | A | 11/1992 | Seifert et al. | |
| 5,653,276 | A | 8/1997 | Niernberger | |
| 5,791,461 | A | 8/1998 | Tsuge | |
| 5,941,375 | A | 8/1999 | Kamens et al. | |
| 6,082,422 | A | 7/2000 | Kaminski | |
| 6,412,627 | B1 | 7/2002 | Tiscione et al. | |
| 6,427,836 | B1 | 8/2002 | Bolanos | |
| 7,334,616 | B2 | 2/2008 | Kaminski | |
| D627,786 | S | 11/2010 | Hsia | |
| D628,795 | S | 12/2010 | Sanders | |
| D630,848 | S | 1/2011 | Long et al. | |
| 7,921,890 | B2 | 4/2011 | Ho | |
| D716,043 | S | 10/2014 | Wilk | |
| D724,841 | S | 3/2015 | Schneider et al. | |
| 9,339,094 | B2 | 5/2016 | Tucker-Show et al. | |
| 9,681,721 | B2 | 6/2017 | Moon | |
| 2004/0026275 | A1 | 2/2004 | Margetts et al. | |
| 2006/0108036 | A1 | 5/2006 | Hui | |
| 2010/0038000 | A1 | 2/2010 | Ho | |
| 2012/0152774 | A1 | 6/2012 | Navon et al. | |
| 2013/0276943 | A1 | 10/2013 | Minn et al. | |
| 2014/0014676 | A1 | 1/2014 | Minson | |
| 2015/0034525 | A1 | 2/2015 | Braxton | |

FOREIGN PATENT DOCUMENTS

| | | |
|---|---|---|
| CN | 102573557 A | 7/2012 |
| JP | 57-112371 | 12/1980 |
| JP | S56-150210 | 10/1981 |
| JP | H07-313233 | 5/1994 |
| JP | H10-099199 | 4/1998 |
| JP | 2001-185781 A | 4/2000 |
| JP | 2005-071342 A | 9/2005 |

OTHER PUBLICATIONS

Adam Hogsett, Machine Era Wallet:, Jul. 22, 2013, pp. 1-9, https://www.kickstarter.com/projects/189943599/machine-era-wallet.

Brandon Boyd Green, "Alpha-World's Best Wallet", May 23, 2014, pp. 1-9, https://www.kickstarter.com/projects/2083673703/alpha-worlds-best-wallet.

International Search Report, dated Oct. 26, 2015, for corresponding International Application No. PCT/US2015/044891.

Written Opinion of the International Searching Authority, dated Oct. 26, 2015, for corresponding International Application No. PCT/US2015/044891.

* cited by examiner

26

44
59
10-10
D1
43

24

28

22
24
43
D1
59
26

44

CARD WALLET

CROSS-REFERENCE TO RELATED APPLICATION

This is a continuation of commonly owned co-pending U.S. application Ser. No. 14/457,403 filed on Aug. 12, 2014, which is hereby incorporated by reference in its entirety for all purposes.

BACKGROUND OF THE INVENTION

The present invention relates generally to a wallet or holder. More specifically, the present invention relates to wallets that are designed to hold a number of bank debit cards, credit cards, identification cards and mechanical or electronic devices approximating the profile of credit cards such as RFID cards. Wallets for carrying credit and identification cards are commonly constructed in a manner that results in a wallet that is significantly larger than the sum of the cards being carried (U.S. Pat. No. 3,659,640). Such conventional wallets are usually made from a leather or synthetic material with an individual pocket for each card, further increasing thickness, mass and bulk. Attempts have been made to design metal cases to hold and protect various identification cards (U.S. Pat. Nos. 1,097,851 and 1,151,248). Conventional metal card wallets of this type require opening of the device to display the cards and to allow the function of RFID cards, and still require the added bulk and potential card damage introduced by metal spring-clips. Still further, such conventional wallets do not allow carrying of a number of cards as the hinge closure dictates the internal volume and limits capacity to either one or two cards. Several wallets were designed to minimize the added bulk through use of simple metal plates and retaining straps to bind the plates and cards together (U.S. Pat. No. 5,653,276). These devices employ a flexible retaining strap with a hook-and-loop fastener (or alternatively a metal hook and loop) to tension cards and currency against a metal plate. More recently, conventional card wallet designs have focused on employing elastic straps (U.S. Patent Publication No. 2013/0276943; and www.kickstarter.com/projects/2083673703/alpha-worlds-best-wallet) or a simple machined metal tray with an elastic strap (www.kickstarter.com/projects/189943599/machine-era-wallet) or use of rubber o-rings to tension two plates against the cards (www.kickstarter.com/projects/331414694/omega-compact-solid-titanium-wallet). Such conventional wallet designs, while successful at minimizing bulk, have the disadvantage of blocking visual access to identification cards and disrupting RFID function due to blocking radio wave propagation. Additionally, the loose nature of the elastic straps or hook-and-loop fasteners makes for insecure retention of contents; or the tight nature of o-rings makes for difficult card insertion or removal. Finally, all wallets utilizing a rubber or polymer elastic member will be vulnerable to wear, stretching or cracking of the elastic member causing eventual failure and all cards will fall out. U.S. Pat. No. 6,082,422 discloses a wallet where the cards are retained by a flat sheet metal enclosure on one side, with L-shaped lips holding the cards on the three edges and tensioned from the reverse side by a spring-clip. However, this type of conventional design leaves one edge open for the cards to fall out when the money clip is opened thereby requiring the addition of a thick clip to properly retain the inserted cards. Thus, if the money clip has been opened, the cards are no longer retained and are able to fall free to the ground. Finally, the spring-clip applies uneven tension on the cards dependent on the number of cards inserted. As such, if only a single card is inserted it is not clamped securely and if many cards are inserted the clamping force is liable to damage the plastic cards. Similarly, U.S. Pat. Nos. 985,525; 1,503,144; and 1,710,828 use one or more metal springs within a box to tension calling cards upward within the box. However, these types of conventional devices do not allow random access of the contained cards—the cards are forced to be dispensed in the loaded order. U.S. Pat. No. 2,084,085 discloses a thin sheet metal card holder with L-shaped lips to retain the cards on two sides, but uses a leather or other flexible folder to contain the cards when closed. The outer folder makes it impossible to view an inserted ID card or to quickly insert or remove any card. U.S. Pat. No. 5,941,375 discloses a thin sleeve device to protect the magnetic stripes on the back of credit cards. However, this device is only capable of carrying a single card and would obscure the user's ability to display an inserted ID card. U.S. Pat. No. 6,412,627 discloses another metal card case that securely holds multiple cards. However, this type of conventional card case does not reduce bulk and weight relative to a traditional leather wallet and also obscures the view of any inserted ID card or the function of any RFID card contained therein.

SUMMARY OF THE INVENTION

One object of the present invention is to provide a card wallet that can easily store and display cards such as bank debit cards, credit cards, identification cards and mechanical or electronic devices approximating the profile of credit cards such as RFID cards.

The present invention is a card wallet for use with a card having lower and upper edge portions and a width W1. The card wallet comprises a base comprising lower and upper end portions. The card wallet further comprises a lower arm comprising an inner end portion engaged with the lower end portion of the base and an outer end portion. The lower arm further comprises a channel portion and a protrusion disposed at said outer end portion blocking entry to the channel portion. Similarly, the upper arm comprises an inner end portion engaged with the upper end portion of the base and an outer end portion. The upper arm comprises a channel portion and a protrusion disposed at said outer end portion of said upper arm blocking entry to the channel portion of the upper arm. The base and channel portions of the lower and upper arms form a retention area to retain the cards. The protrusions of the lower and upper arms are moveable between a non-biased position where the retention area is closed and a biased position where the retention area is open. In operation, the protrusions of the lower and upper arms are moved to the biased position upon contact with and insertion of the lower and upper edge portions of the card at the protrusions of the lower and upper arms allowing complete insertion of the cards within the channel portions of the lower and upper arms and then return of the protrusions of the lower and upper arms to the non-biased position where the cards are retained within the retention area.

BRIEF DESCRIPTION OF THE DRAWINGS

The following description of the invention will be further understood with reference to the accompanying drawings, in which.

DETAILED DESCRIPTION OF THE INVENTION

Figure 2:
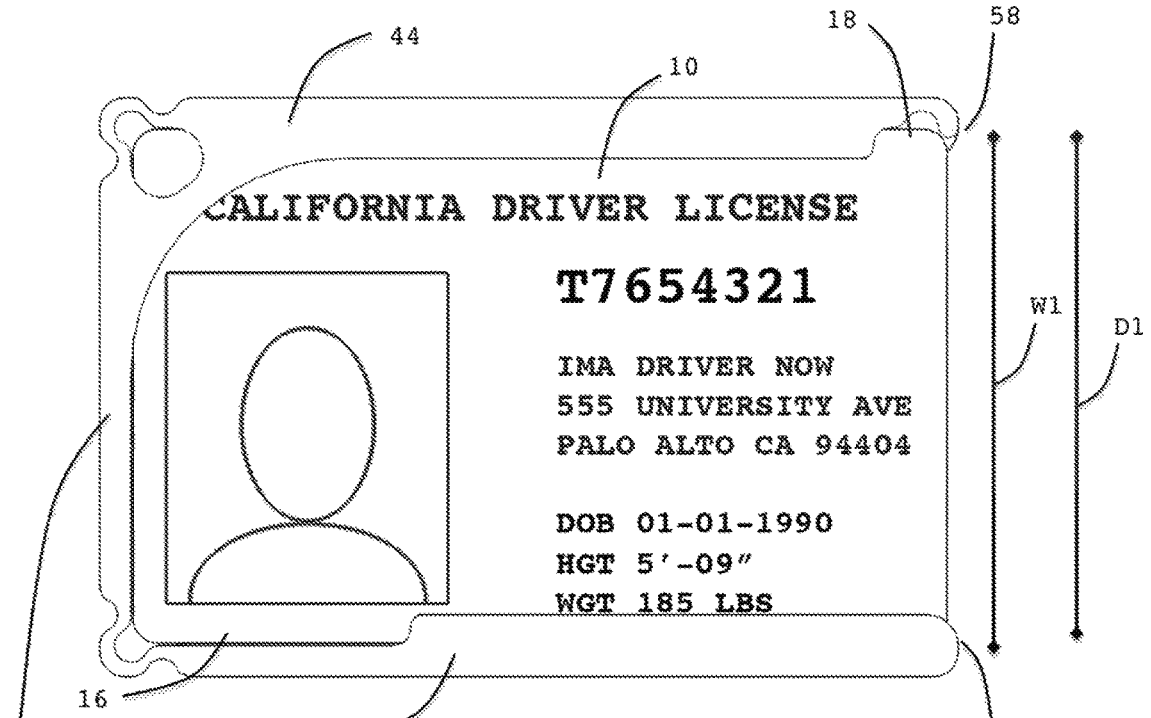
FIG. 2 is a front plan view of the card wallet with multiple cards retained therein and displaying and making accessible a first card such as a drivers license.
Figure 3:
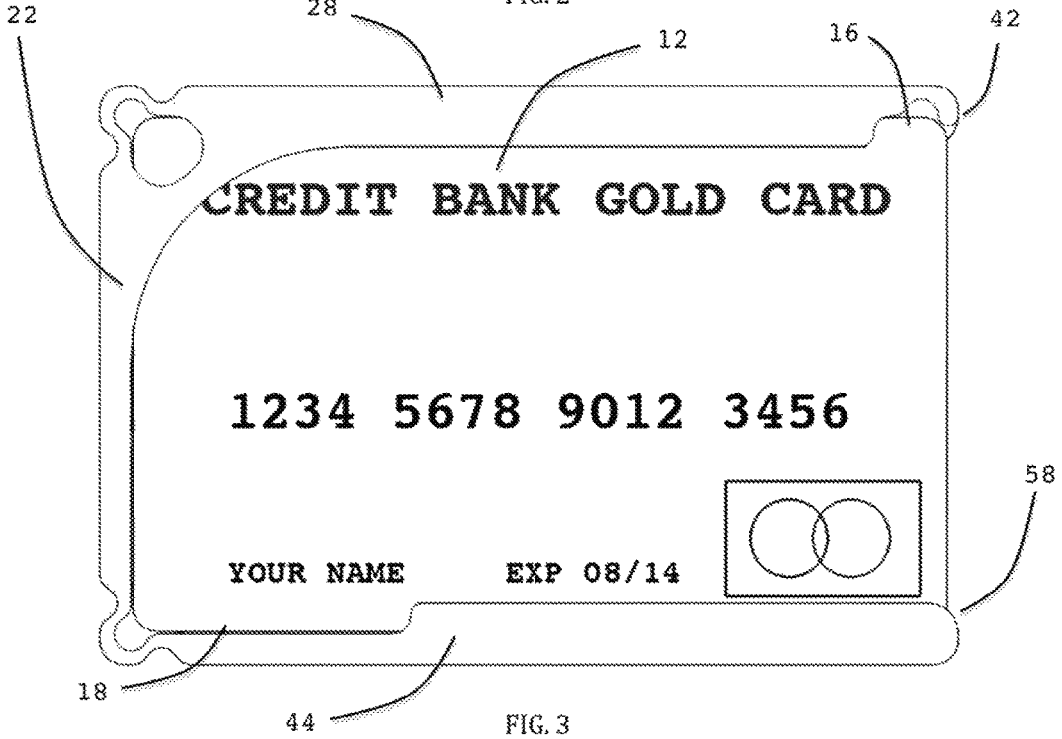
FIG. 3 is a rear plan view of the card wallet of FIG. 2 displaying and making accessible a second card such as a credit card.
Figures 4, 5, 6, 7, 8, 9:
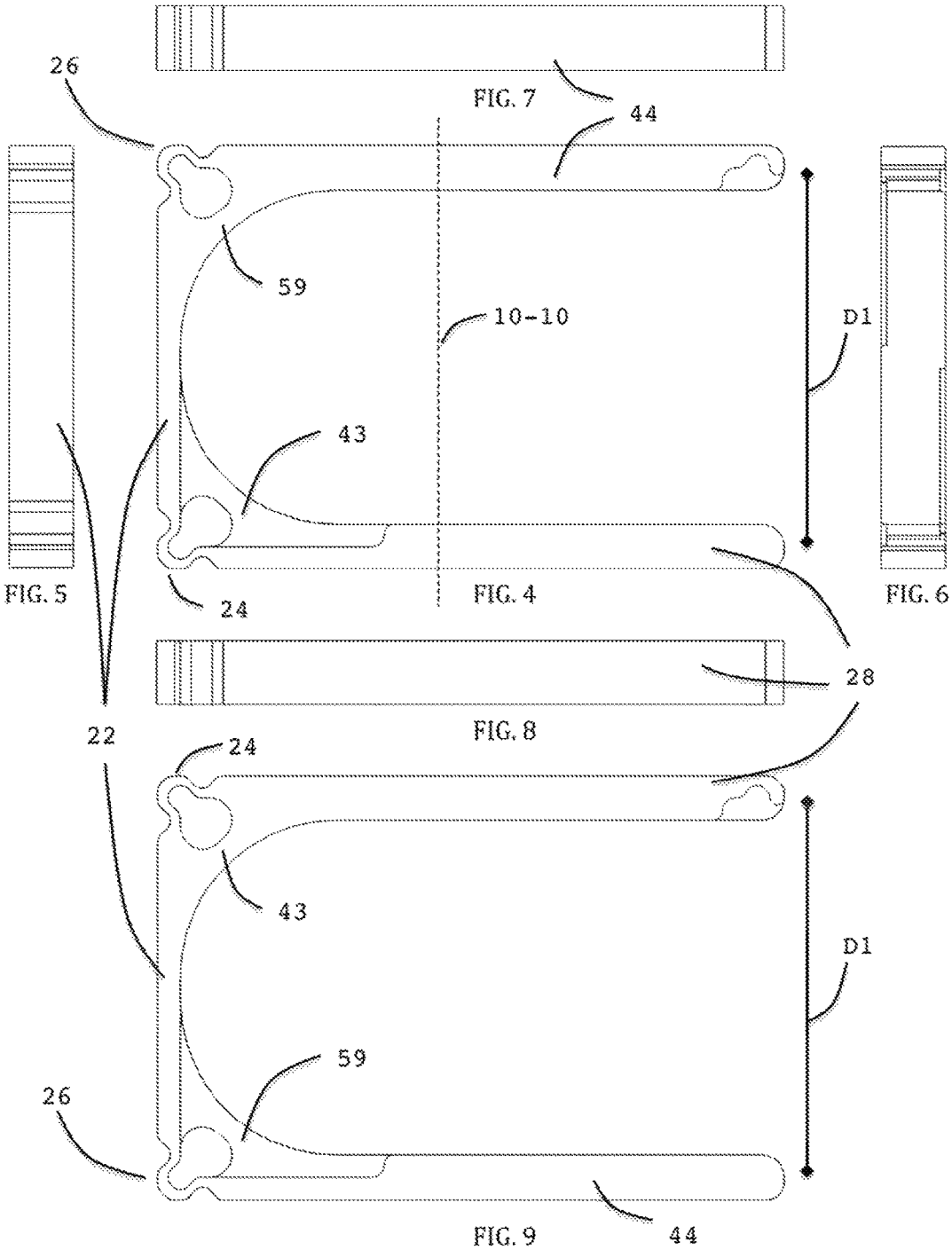
FIG. 4 is a front view of the card wallet.
FIG. 5 is a left side view of the card wallet.
FIG. 6 is a right side view of the card wallet.
FIG. 7 is a top view of the card wallet.
FIG. 8 is a bottom view of the card wallet.
FIG. 9 is a rear view of the card wallet.
Figure 10:
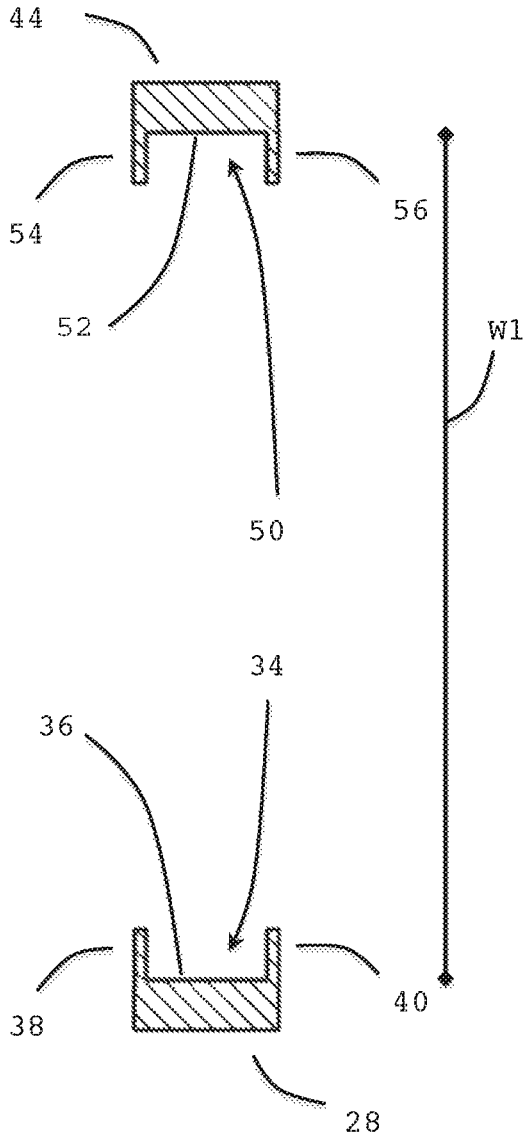
FIG. 10 is a cross section view taken along line 10-10 of FIG. 4.

Referring to FIGS. 1A, 1B, and FIGS. 2-3, the present invention is a card wallet 20 that securely stores and displays a first card 10 such as a drivers license (FIG. 2) and a second card 12 such as a credit card (FIG. 3).

Referring to FIG. 2, each of cards 10 and 12 comprise a lower edge portion 16, an upper edge portion 18, and a width W1. The term "card" means any conventional bank debit cards, credit cards, identification cards such as driver licenses, and any mechanical and/or electronic device, now existing or futurely developed, approximating the profile of a conventional credit card such as RFID cards. The standard credit card size is called the ID-1 document format and the dimensions are 85.60×53.98 mm (3.370×2.125 in) and a thickness of 0.76 mm (0.030 in).

Figure 1A:
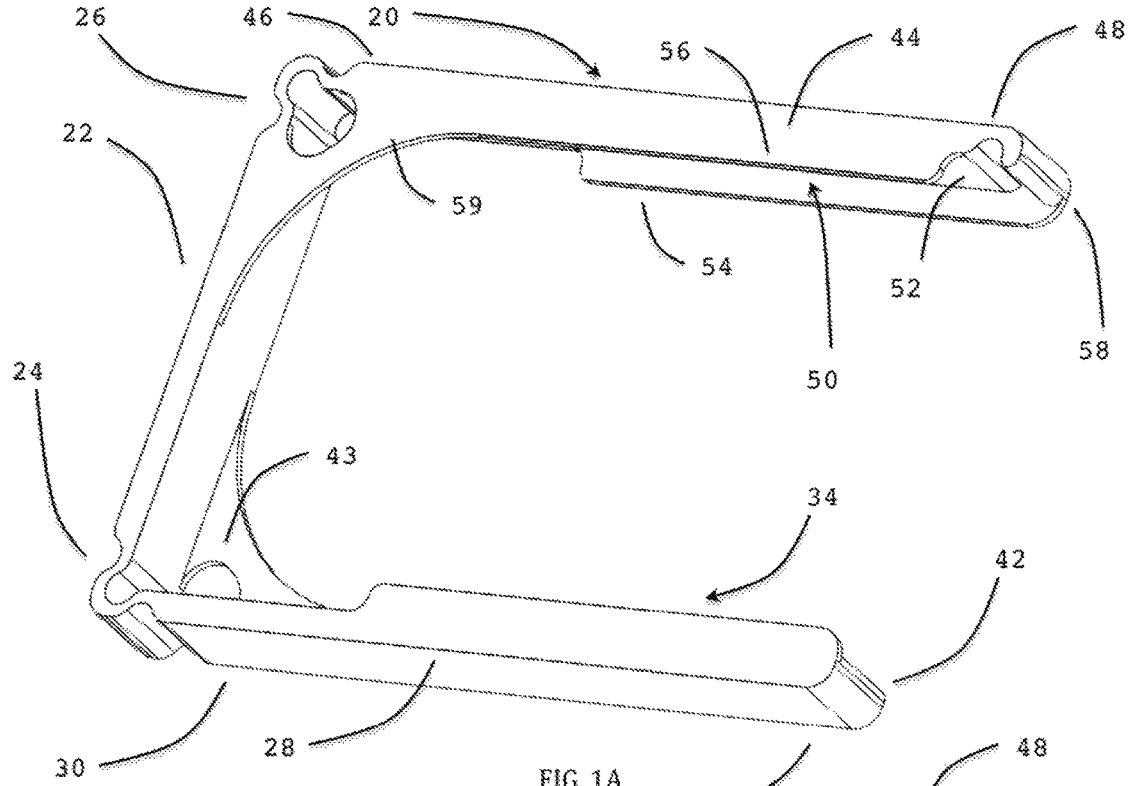
FIG. 1A is a front perspective view of a card wallet according to the present invention.
Figure 1B:
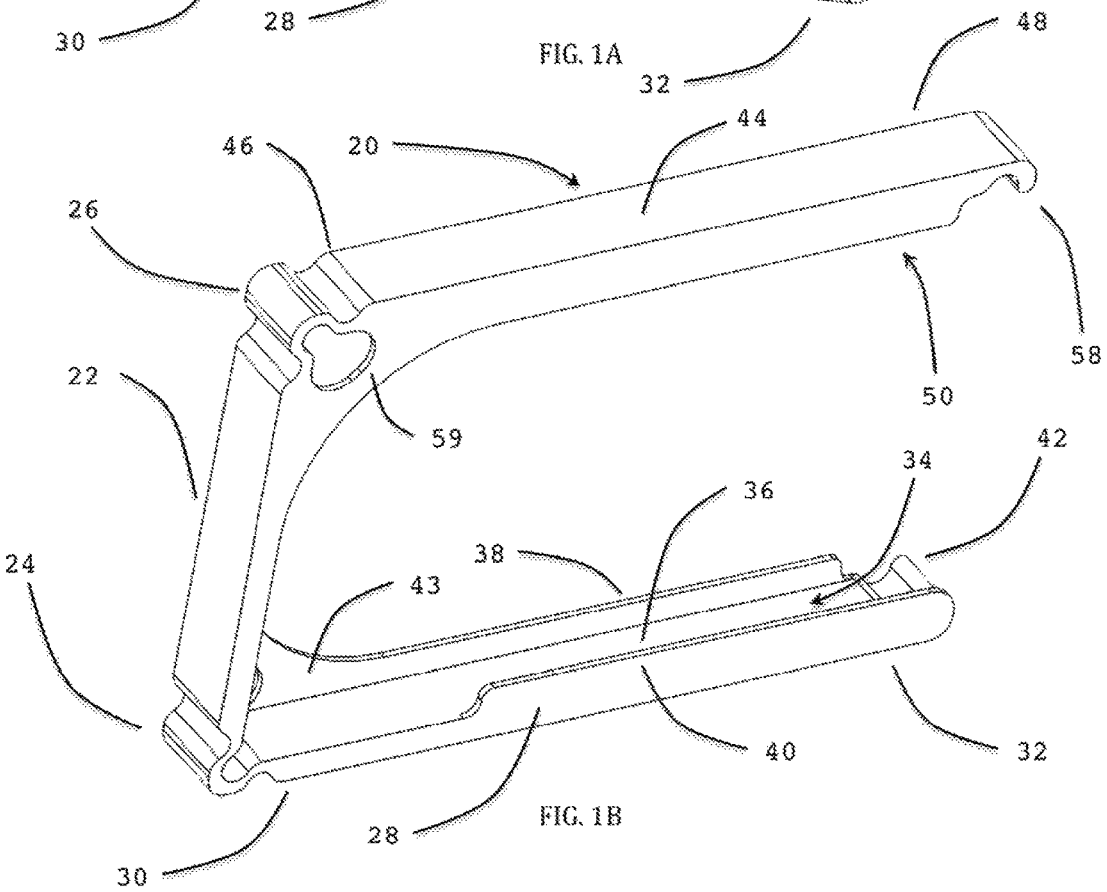
FIG. 1B is a front perspective view of the card wallet.
Figure 1C:
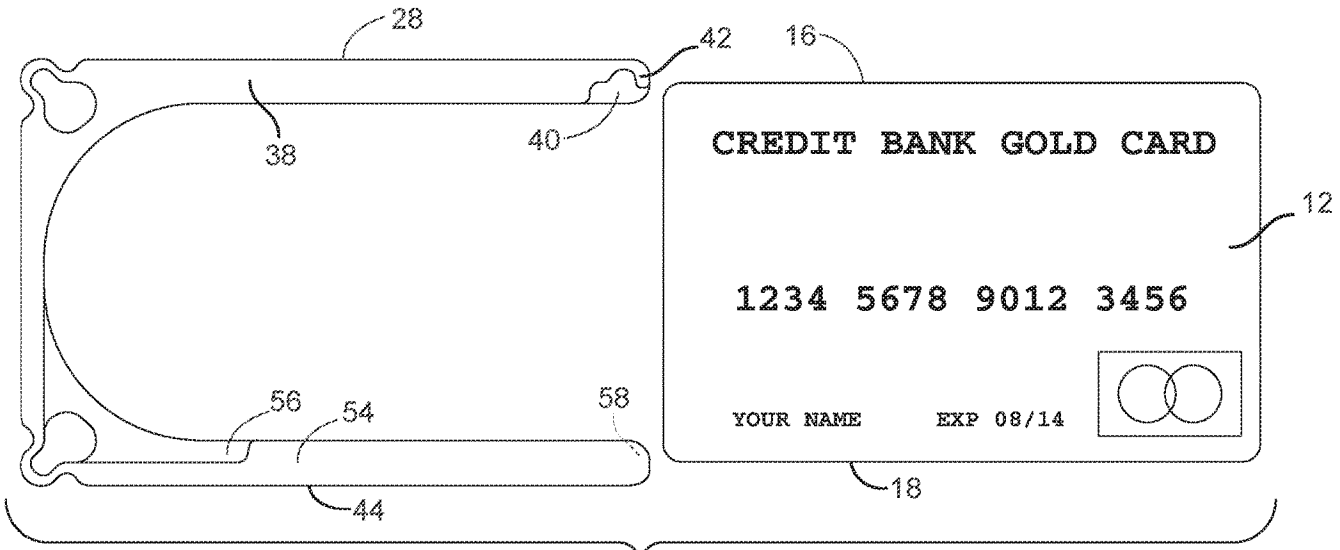
FIG. 1C is a plan view of the card wallet where the protrusion are in a non-biased position with the card ready for insertion.
Figure 1D:
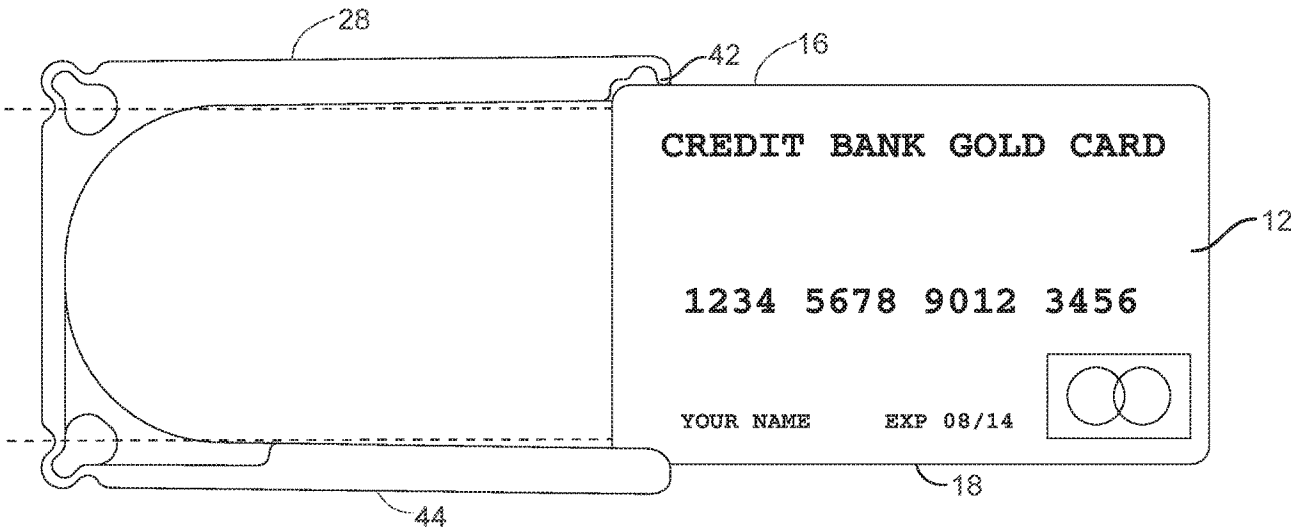
FIG. 1D is a plan view of the card wallet where the protrusions are in a biased position upon insertion of the bottom and top edge portions of a card.

Referring to FIGS. 1A and 1B, and FIGS. 4-10, card wallet 20 generally comprises a base 22, a lower arm, 28, and an upper arm 44. Base 22 comprises a lower end portion 24 and an upper end portion 26. Lower arm 28 comprises an inner end portion 30 engaged with lower end portion 24 of base 22, and an outer end portion 32. Lower arm 28 further comprises a C-shaped channel portion 34 comprising a floor 36 and sidewalls 38 and 40. Lower arm 28 further comprises a protrusion 42 engaged with and extending inward from outer end portion 32 blocking entry to channel portion 34 of lower arm 28. Upper arm 44 comprises an inner end portion 46 engaged with upper end portion 26 of base 22 and an outer end portion 48. Upper arm 44 further comprises a C-shaped channel portion 50 (FIG. 10) comprising a floor 52 and sidewalls 54 and 56. Upper arm 44 further comprises a protrusion 58 engaged with and extending inward from outer end portion 48 blocking entry to channel portion 50 of upper arm 44. Base 22 and channel portions 34 and 50 of lower and upper arms 28 and 44, respectively, form a retention area to retain first and second cards 10 and 12. Channel portion 50 of upper arm 44 is spaced from and substantially aligned with channel portion 34 of lower arm 28. Lower arm 28 is substantially perpendicular to base 22. Upper arm 44 is substantially perpendicular to base 22. In a non-biased state or position where lower and upper arms 28 and 44 are not stressed or moved, the distance D1 between protrusions 42 and 58 is 52.40 mm (2.0630 in) and cards 10 and 12 cannot be removed from the retention area. Protrusions 42 and 58 of lower and upper arms 28 and 44, respectively, are moveable between the non-biased position (see FIGS. 1A-1C, and 4-10) where the retention area is closed and a biased position (see FIG. 1D, dotted reference lines show position of the protrusions moveable to the biased position relative to the non-biased position) where the retention area is open allowing cards 10 and 12 to be inserted into the retention area. Protrusion 42 of lower arm 28 is spaced a distance D1 from protrusion 58 of upper arm 44 in said non-biased position. Distance D1 is smaller than the width W1 of the cards in the non-biased position (see FIGS. 1A-1C, and 4-10). In operation, protrusions 42 and 58 of lower and upper arms 28 and 44, respectively, are moved to the biased position (see FIG. 1D) upon insertion of the lower and upper edge portions 16 and 18 of cards 10 and 12 at protrusions 42 and 58 allowing complete insertion of cards 10 and 12 within channel portions 34 and 50 of lower and upper arms 28 and 44, respectively, and then return of the protrusions of lower and upper arms 28 and 44 to the non-biased position where cards 10 and 12 are retained within the retention area (see FIGS. 2 and 3). Protrusions 42 and 58 are sized and cylindrically shaped to securely retain cards 10 and 12, yet also provide a smooth surface to release cards 10 and 12 when manually manipulated. Channel portions 34 and 50 of lower and upper arms 28 and 44, respectively, protrude as far into the opening as possible to assist aligning cards for insertion.

Card wallet 20 is made by conventional machining operations from a single piece of material such as a billet of aluminum 6061-T6 or 7075-T6 alloy, with a central card slot forming channel portions 34 and 50 of lower and upper arms 28 and 44, respectively. Lower arm 28 further comprises a corner gusset 43 at inner end portion 30 joining base 22 to prevent bending lower arm 28 beyond the elastic limit of the billet material. Similarly, upper arm 44 further comprises a corner gusset 59 at inner end portion 46 joining base 22 to prevent bending upper arm 44 beyond the elastic limit of the billet material. Round features in corners gussets 43 and 59 are employed as stress relief to prevent localized stress fractures. Base 22 forms a torsion bar to allow upper and lower arms 28 and 44 to flex just enough to permit cards 10 and 12 to be inserted and removed. Use of heat treated and age hardened aluminum alloys will help ensure that the repeated flexing does not result in stress fracturing. However, the billet can consist of any other material that can be repeatedly flexed without fracturing, such as other aluminum alloys, stainless steel, titanium alloys, carbon fiber, or other composites or polymer materials.

Card wallet 20 provides significant improvements and advantages over conventional card wallets. First, card wallet 20 is significantly lighter than conventional card wallets. Second, card wallet 20 positively locks or retains the inserted cards without the use of elastics or springs that subsequently fail and require periodic replacement. Third, card wallet 20 provides unobstructed views of cards 10 and 12 to establish the bearer's identity. Fourth, cards 10 and 12 are securely held within the retention area without damage to the cards. Fifth, card wallet 20 allows the cards to be stacked in any desired manner and allows two of the stacked cards to be fully displayed.

In alternative embodiments, spring loaded protrusions may replace the stationary protrusions thereby eliminating the need for flexing of base 22. In other embodiments, lower and upper arms 28 and 44 of card wallet 20 may be separate pieces connected to base 22 by conventional fastening means such as screws and threaded holes. In other embodiments, card wallet 20 may employ multiple channels with each of channel portions 34 and 50 of lower and upper arms 28 and 44, respectively, thereby allowing a single card to be inserted within a single channel. In other embodiments, the distance between sidewalls 38 and 40 on lower arm 28 and sidewalls 54 and 56 on upper arm 44 could be made smaller or larger to allow insertion of fewer or larger number of cards, respectively. Channel portion 34 and 50 of lower and upper arms 28 and 44, respectively, are C-shaped but may comprise a variety of other shapes such as square and rectangular shaped.

While particular embodiments of the invention have been shown and described, it will be obvious to those skilled in the art that changes and modifications may be made without departing from the scope of the claimed invention.

What is claimed is:

1. A card wallet for use with a card having lower and upper edge portions and a width W1, the card wallet comprising:

a base comprising lower and upper end portions;

a lower arm comprising an inner end portion engaged with said lower end portion of said base and an outer end portion; said lower arm further comprises a channel portion and a protrusion disposed at said outer end portion blocking entry to said channel portion; said channel portion of the lower arm having a level channel floor between the inner end portion and the outer end portion;

an upper arm comprising an inner end portion engaged with said upper end portion of said base and an outer end portion; said upper arm comprising a channel portion and a protrusion disposed at said outer end portion of said upper arm blocking entry to said channel portion of said upper arm; said channel portion of the upper arm having a level channel floor between the inner end portion and the outer end portion;

the upper and lower arms engaged to the base only at the inner end portions of the upper and lower arms, providing an opening through the card wallet of unobstructed display of the card from both an outermost exterior front surface and an outermost exterior rear surface of the card wallet;

the lower arm comprises only one gusset disposed at the outermost exterior rear surface and the upper arm comprises only one gusset disposed at the outermost exterior front surface; and said base and said channel portions of said lower and upper arms form a retention area to retain the card;

at least one of said protrusions of said lower and upper arms is moveable as at least one of the lower and upper arms flex between a non-biased position where said retention area is closed and a biased position where said retention area is open;

at least one of said protrusions of said lower and upper arms are moved to said biased position upon insertion of the card allowing complete insertion of the card within said channel portions of said lower and upper arms and then return of at least one of said protrusions of said lower and upper arms to said non-biased position where the card is retained within said retention area.

2. The card wallet of claim 1, wherein the outermost exterior front surface is axially symmetrical to the outermost exterior rear surface about a longitudinal axis of the card wallet.

3. The card wallet of claim 1, wherein the protrusion of the lower arm extends inward toward a longitudinal axis of the card wallet and the protrusion of the upper arm extends inward toward the longitudinal axis.

4. The card wallet of claim 1, wherein said channel portion of said upper arm is spaced from and substantially aligned with said channel portion of said lower arm.

5. The card wallet of claim 1, wherein said protrusion of said lower arm is spaced a distance D1 from said protrusion of said upper arm in said non-biased position; said distance D1 is smaller than the width W1 of the card.

6. The card wallet of claim 1, wherein each of said protrusions of said lower and upper arms are rounded.

7. The card wallet of claim 1, wherein the entire card wallet is made from a one piece material.

8. A card wallet for use with a card having lower and upper edge portions and a width W1, the card wallet comprising:

a base comprising lower and upper end portions;

a lower arm comprising an inner end portion engaged with said lower end portion of said base and an outer end portion; said lower arm further comprises a channel portion and a protrusion disposed at said outer end portion blocking entry to said channel portion; said channel portion of the lower arm having a level channel floor between the inner end portion and the outer end portion;

an upper arm comprising an inner end portion engaged with said upper end portion of said base and an outer end portion; said upper arm comprising a channel portion and a protrusion disposed at said outer end portion of said upper arm blocking entry to said channel portion of said upper arm; said channel portion of the upper arm having a level channel floor between the inner end portion and the outer end portion;

said base and said channel portions of said lower and upper arms form a retention area to retain the card;

the upper and lower arms engaged to the base only at the inner end portions of the upper and lower arms, providing an opening through the card wallet of unobstructed display of the card from both an outermost exterior front surface and an outermost exterior rear surface of the card wallet;

the lower arm comprises only one gusset disposed at the outermost exterior front or rear surface and the upper arm comprises only one gusset disposed at the outermost exterior front or rear surface; and at least one of said protrusions of said lower and upper arms is moveable as at least one of the lower and upper arms flex between a non-biased position where said retention area is closed and a biased position where said retention area is open; at least one of said protrusions of said lower and upper arms are moved to said biased position upon insertion of the card allowing complete insertion of the card within said channel portions of said lower and upper arms and then return of at least one of said protrusions of said lower and upper arms to said non-biased position where the card is retained within said retention area.

9. The card wallet of claim 8, wherein the outermost exterior front surface is axially symmetrical to the outermost exterior rear surface about a longitudinal axis of the card wallet.

10. The card wallet of claim 8, wherein the protrusion of the lower arm extends inward toward a longitudinal axis of the card wallet.

11. The card wallet of claim 8, wherein the protrusion of the upper arm extends inward toward a longitudinal axis.

12. The card wallet of claim 8, wherein said protrusion of said lower arm is spaced a distance D1 from said protrusion of said upper arm in said non-biased position; said distance D1 is smaller than the width W1 of the card.

13. The card wallet of claim 8, wherein each of said protrusions of said lower and upper arms are rounded.

14. The card wallet of claim 8, wherein the base comprises a level inner surface configured to rest flush against a parallel width side of the card retained in said retention area.

15. The card wallet of claim 8, wherein at least one of the gussets comprises an aperture.

16. The card wallet of claim 8, wherein the entire card wallet is made from a one piece material.

* * * * *